US011158294B2

(12) United States Patent
Groover

(10) Patent No.: US 11,158,294 B2
(45) Date of Patent: Oct. 26, 2021

(54) ELECTRONIC MUSICAL INSTRUMENT

(71) Applicant: Keith Groover, Spartanburg, SC (US)

(72) Inventor: Keith Groover, Spartanburg, SC (US)

( * ) Notice: Subject to any disclaimer, the term of this patent is extended or adjusted under 35 U.S.C. 154(b) by 0 days.

(21) Appl. No.: 16/564,732

(22) Filed: Sep. 9, 2019

(65) Prior Publication Data

US 2020/0082800 A1 Mar. 12, 2020

Related U.S. Application Data

(60) Provisional application No. 62/728,347, filed on Sep. 7, 2018.

(51) Int. Cl.
*G10H 1/00* (2006.01)

(52) U.S. Cl.
CPC ..... *G10H 1/0008* (2013.01); *G10H 2210/325* (2013.01); *G10H 2220/201* (2013.01); *G10H 2220/395* (2013.01)

(58) Field of Classification Search
CPC ..... G10H 1/0008; G10H 2210/325; G10H 2220/201; G10H 2220/395; G10H 2210/221; G10H 2220/391; G10H 2220/315; G10H 1/46; G10H 2210/525; G10H 2220/246; G10H 1/34
See application file for complete search history.

(56) References Cited

U.S. PATENT DOCUMENTS 4,998,457 A * 3/1991 Suzuki ..... G10H 1/0556 341/27
5,313,010 A * 5/1994 Matsushima ..... G10H 1/00 84/600
5,648,626 A * 7/1997 Okamoto ..... G10H 1/34 84/600
7,135,637 B2 * 11/2006 Nishitani ..... A63B 71/0686 84/723
2011/0316793 A1 12/2011 Fushiki
2013/0215070 A1 8/2013 Sasaki
2014/0149911 A1 5/2014 Lam

FOREIGN PATENT DOCUMENTS

EP 0322824 7/1989
EP 2945045 11/2015
WO WO 2010/068179 6/2010

OTHER PUBLICATIONS

International Search Report and Written Opinion for PCT/US2019/050219, dated Dec. 12, 2019, 15 pages.

* cited by examiner

*Primary Examiner* — Jeffrey Donels
(74) *Attorney, Agent, or Firm* — Dority & Manning, P.A.

(57) ABSTRACT

Systems and methods are directed to generating music. In one example, an electronic musical instrument includes a first handheld unit. The electronic musical instrument further includes a second handheld unit, the second handheld unit being communicatively coupled to the first handheld unit. The first handheld unit includes a plurality of input controls configured to indicate a selection of a note of a musical scale. The second handheld unit is configured to initiate output of the selected note.

20 Claims, 5 Drawing Sheets

ELECTRONIC MUSICAL INSTRUMENT

PRIORITY CLAIM

The present application is based on and claims benefit of U.S. Provisional Application 62/728,347 having a filing date of Sep. 7, 2018, which is incorporated by reference herein.

FIELD

The present disclosure relates generally to generating sound. More particularly, the present disclosure relates to an electronic musical instrument and methods for using the same to generate music based in part on user inputs and user movement.

BACKGROUND

Electronic musical instruments produce sound using electronic circuitry. An electronic musical instrument can produce sounds by outputting an audio signal via a device such as a power amplifier, which drives a loudspeaker, creating sound.

SUMMARY

Aspects and advantages of embodiments of the present disclosure will be set forth in part in the following description, or can be learned from the description, or can be learned through practice of the embodiment.

One example aspect of the present disclosure is directed to an electronic musical instrument device. The electronic musical instrument includes a first handheld unit. The electronic musical instrument device further includes a second handheld unit, the second handheld unit being communicatively coupled to the first handheld unit. The first handheld unit includes a plurality of input controls configured to indicate a selection of a note of a diatonic scale. The second handheld unit is configured to initiate output of the selected note.

Another example aspect of the present disclosure is directed to a computer-implemented method for generating music. The method includes obtaining, by a computing device, an indication of a note selected at a first handheld unit. The method further includes obtaining, by the computing system, an indication of an octave for the selected note from a second handheld device. The method further includes obtaining, by the computing device, an indication to initiate output of the selected note from the second handheld device. The method further includes providing, by the computing device to an output device, one or more signals to generate sound output comprising the selected note.

Another example aspect of the present disclosure is directed to a system. The system includes a first handheld unit comprising a plurality of input controls. The system further includes a second handheld unit including a plurality of input controls, the second handheld unit being communicatively coupled to the first handheld unit. The system further includes one or more output devices, the one or more output devices being in communication with the first handheld unit. The first handled unit further includes one or more processors and one or more memories including instructions that, when executed by the one or more processors, cause the one or more processors to perform operations. The operations include determining a selected note based on activation of one or more of the plurality of input controls. The operations further include obtaining an indication of an octave for the selected note from the second handheld unit. The operations further include obtaining an indication to initiate output of the selected note from the second handheld unit, the indication to initiate output of the selected note based at least in part on a determination of movement of the second handheld unit. The operations further include providing one or more signals to the one or more output devices to provide for generation of sound output based on the selected note.

Other aspects of the present disclosure are directed to various systems, apparatuses, and electronic devices.

These and other features, aspects, and advantages of various embodiments of the present disclosure will become better understood with reference to the following description and appended claims. The accompanying drawings, which are incorporated in and constitute a part of this specification, illustrate example embodiments of the present disclosure and, together with the description, serve to explain the related principles.

BRIEF DESCRIPTION OF THE DRAWINGS

Detailed discussion of embodiments directed to one of ordinary skill in the art is set forth in the specification, which makes reference to the appended figures, in which.

DETAILED DESCRIPTION

Figure 1:
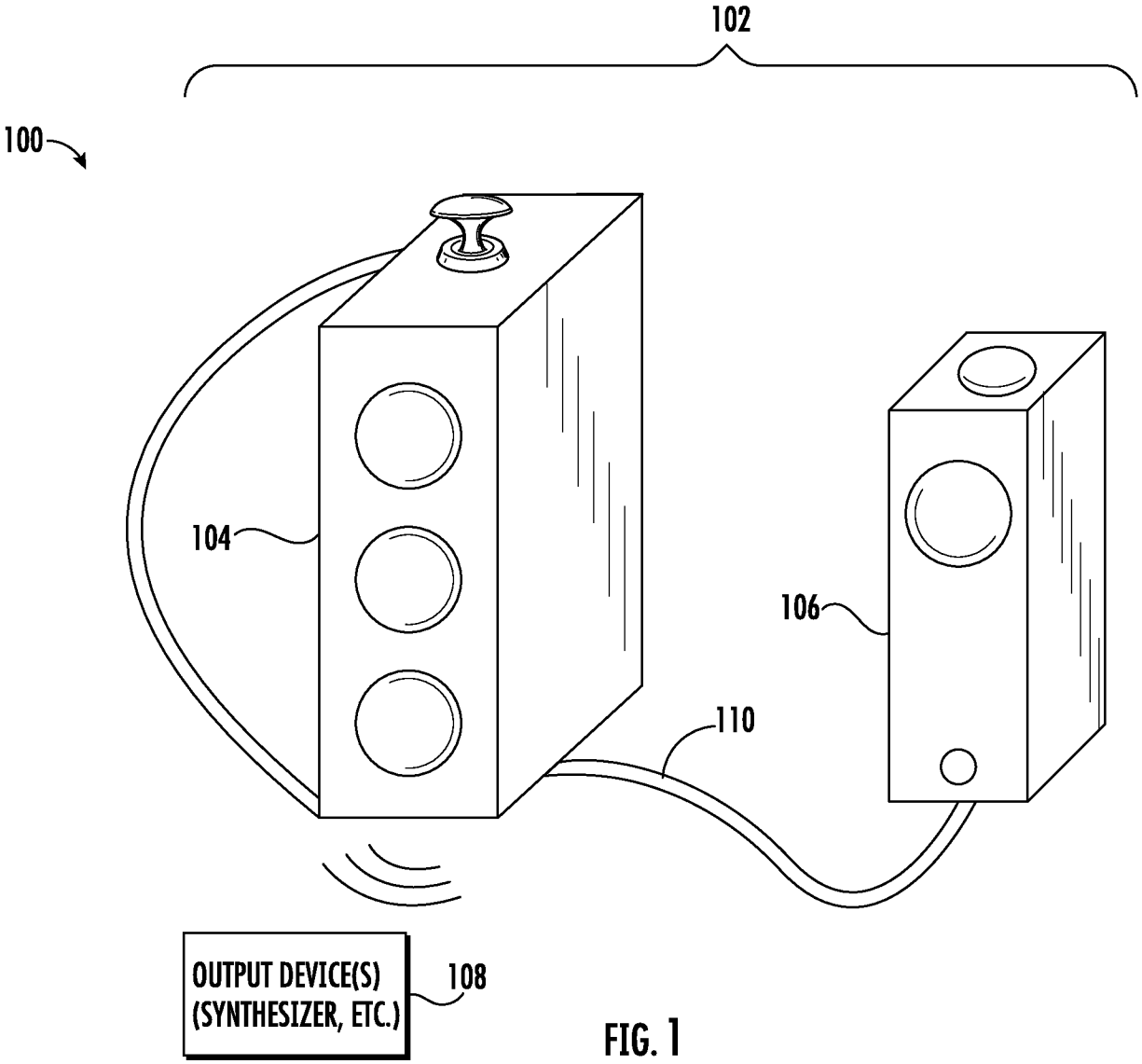
FIG. 1 depicts a diagram of an example system for generating music according to example embodiments of the present disclosure.

Reference now will be made in detail to embodiments, one or more example(s) of which are illustrated in the drawings. Each example is provided by way of explanation of the embodiments, not limitation of the present disclosure. In fact, it will be apparent to those skilled in the art that various modifications and variations can be made to the embodiments without departing from the scope of the present disclosure. For instance, features illustrated or described as part of one embodiment can be used with another embodiment to yield a still further embodiment. Thus, it is intended that aspects of the present disclosure cover such modifications and variations.

Generally, the present disclosure is directed to an electronic musical instrument. In particular, an electronic musical instrument can include handheld units configured to obtain user input and/or sensor data (e.g., motion data, etc.) associated with one or more of the handheld units for use in generating signal data associated with playing musical notes. The signal data can be used by an output device, such as a synthesizer, for example, to produce the musical notes as audio output. More particularly, in some implementations, the electronic musical instrument can include a first handheld unit configured to determine a musical note that is to be outputted and a second handheld unit can be configured to indicate that the output of the musical note should be initiated and/or to determine one or more aspects of the musical note being outputted.

According to an aspect of the present disclosure, an electronic musical instrument can include a first handheld unit and a second handheld unit that are communicatively coupled (e.g., connected via a communication cable, etc.). A user can manipulate the first handheld unit and the second handheld unit to generate signals used to produce a musical output at an output device such as, for example, a synthesizer.

The first handheld unit can include a plurality of input controls, for example, buttons and/or the like, configured to provide for the selection of musical notes. For example, the first handheld unit can include three input controls (e.g., buttons, etc.) that can be depressed in a plurality of defined sequences to indicate the selection of a musical note, for example, where each of the button press sequences is associated with a particular musical note of a musical scale (e.g., the diatonic scale). The first handheld unit can be configured with the note selection input controls (e.g., buttons, etc.) being aligned close together on a first face of the first handheld unit such that a user can easily depress one or more of the note selection input controls (e.g., with a first hand) to indicate selection of the desired musical note.

The second handheld unit can include one or more sensors, such as an accelerometer or the like, for example, that can provide sensor data indicating that the musical note selected at the first handheld unit should be generated as audio output. For example, in some implementations, the second handheld unit can be moved by the user, for example, in a striking or hitting motion, to indicate that the selected musical note should be output. In some implementations, the one or more sensors may determine a force with which the motion of the second handheld unit is made and adjust an aspect of the musical note being output. This can include, for example, increasing the volume of the musical note based on a harder hit motion or decreasing the volume of the musical note based on a softer hit motion. In some implementations, the second handheld unit may determine other aspects to be applied for the output of the musical note based on a pattern of motion of the second handheld unit. For example, the second handheld unit may determine that the pitch of the musical note being output should be modified, such as by bending the pitch up or down slightly, based on the user making a repeating striking motion with the second handheld unit. In some implementations, the speed and/or intensity of the motion applied to the second handheld unit can directly correlate with how much the pitch is bent.

The second handheld unit can also include a plurality of input controls, for example, buttons and/or the like, configured to allow for an indication of an octave for the selected musical note. For example, the second handheld can include two input controls (e.g., buttons, etc.) that can be depressed in a plurality of defined sequences to indicate selection of an octave for the selected musical note. As an example, in one implementation, a first (e.g., lowest) octave can be indicated by a first button being depressed. A second (e.g., next higher) octave can be indicated by the first button and a second button being depressed. A third (e.g., next higher) octave can be indicated by just the second button being depressed. A fourth (e.g., highest) octave can be indicated by neither of the buttons being depressed. In some implementations, the second handheld unit can be configured with the first octave selection input control (e.g., button, etc.) being positioned on a first face of the second handheld unit and the second octave selection input control (e.g., button, etc.) being positioned on a second adjoining face of the second handheld unit.

The first handheld unit can include an additional input control, such as a thumb stick, a directional pad, and/or the like, configured to provide for selection of additional aspects associated with a musical note. In some implementations, the additional input control (e.g., thumb stick, directional pad, etc.) can be moved in a first direction (or a first direction can be selected on a directional pad, etc.) to indicate a sharp for the selected note (e.g., based on the input buttons that are being pressed concurrently with the thumb stick movement). The additional input control (e.g., thumb stick) can be moved in a second direction (or a second direction selected on a directional pad, etc.) to indicate a flat for the selected note (e.g., based on the input buttons that are being pressed concurrently with the thumb stick movement).

Additionally, in some implementations, the additional input control can be moved in a third or fourth direction to indicate a transposition for the selected musical notes. For example, the additional input control (e.g., thumb stick, directional pad, etc.) can be moved in a third direction (or a third direction can be selected on a directional pad, etc.) to indicate a chromatic transposition, where the musical notes are shifted by a fixed number of steps (e.g. keys), for example, based on a change in the selected musical notes (e.g., a change of input control selection from a C to a D would cause a shift of one step in the next note being outputted, a change of input control selection from a C to an E would cause a shift of two steps in the next note being outputted, etc.). Further, the additional input control (e.g., thumb stick, directional pad, etc.) can be moved in a fourth direction (or a fourth direction can be selected on a directional pad, etc.) to indicate a diatonic transposition, where a next note to be outputted would move a fixed number of notes in the scale within the same key. In some implementations, the additional input control can be moved in a fifth direction (e.g., center down press, etc.) to change an output mode. In one example, the additional input control can be moved in a fifth direction to allow for changing between a normal mode and a legato mode. In a normal mode, the musical note being output can be held while the user indicates a next musical note to be output by changing the selected input controls of the first handheld unit. The second handheld unit can then be moved to indicate that output should change from the musical note being held to the next musical note. In a legato mode, the musical note being output changes from the current musical note to the next selected musical note as soon as a user changes the input controls selected on the first handheld unit.

In some implementations, the first handheld unit can also include one or more sensors, such as an accelerometer or the like, for example, that can provide sensor data for use in determining one or more aspects of the musical note selected to be generated as audio output. For example, in some implementations, the first handheld unit can be moved by the user, for example, in a side to side rotating motion, to indicate an adjustment to the volume level of the musical note being output. For example, a user can rotate the first handheld unit in a first direction to increase the volume of the musical notes output and can rotate the first handheld unit in a second opposite direction to decrease the volume of the musical notes output.

Additionally, in some implementations, the musical note being outputted can be held (e.g., continue to be played) until all the input controls (e.g., buttons, etc.) are released. In such implementations, this can allow for a second musical note to be selected (e.g., a change in the input buttons depressed on the first handheld unit) such that the second musical note is played immediately upon the user making the appropriate motion with the second handheld unit (e.g., a hitting motion). Further, in such implementations, the sensor data indicative of movement of the first handheld unit (e.g., a forward/backward tilt motion of the first handheld unit) after the selection of a second musical note (e.g., while the first, current musical note is being output) can be used to indicate that a slide transition from the first musical note to the second musical note should be applied. For example, while the first selected musical note is being played (e.g., held), a user can indicate selection of a second musical note (e.g., by changing the input buttons depressed on the first handheld unit) and move the first handheld unit in a backward tilt motion to indicate a transition where the musical notes being output slide from the first musical note to the second musical note. Additionally, in some implementations, the user can move the first handheld unit in a forward tilt motion to indicate a transition where the musical notes being output slide from the second musical note back to the first musical note. In some implementations, the repeated movement of the first handheld unit in a backward/forward tilt motion can indicate that the musical notes being output should slide from a first musical note, to a second musical note, to a third musical note, to a fourth musical note, etc. as one sustained series.

With reference to the figures, example embodiments of the present disclosure will be discussed in further detail.

FIG. 1 depicts a diagram of an example system 100 for generating music according to example embodiments of the present disclosure. As illustrated in FIG. 1, a system 100 for generating music can include an electronic musical instrument 102 and an audio output device 108 (e.g., a synthesizer, etc.). The electronic musical instrument 102 can include a first handheld unit 104 and a second handheld unit 106 that can be operated concurrently to provide for a selection of musical notes to be produced by the audio output device 108. The first handheld unit 104 and second handheld unit 106 of the musical instrument 102 can be connected together, for example by a communication cable 110, to allow for communication between the first handheld unit 104 and second handheld unit 106. In some implementations, the musical instrument 102 (e.g., the second handheld unit 104) can communicate with the audio output device 108 via a wireless communication protocol, such as Bluetooth and/or the like.

The first handheld unit 104 of the electronic musical instrument 102 can include a plurality of input controls, for example buttons and/or the like, that can be operated (e.g., pressed) by a user in a plurality of defined combinations to indicate the selection of particular musical notes (e.g., a note of a diatonic scale, etc.). In some implementations, for example, the first handheld unit can include three input buttons that can be depressed in a plurality of defined combinations to indicate selection of a musical note (e.g., where each pressed button combination is associated with a particular musical note of a musical scale). The first handheld unit 104 can also include one or more additional input controls to provide for selecting additional aspects of the musical note that is to be output (e.g., sharps, flats, transpositions, volume, etc.).

The second handheld unit 106 of the electronic musical instrument 102 can include a plurality of input controls, for example buttons and/or the like, that can be operated (e.g., pressed) by a user in a plurality of defined combinations to indicate the selection of an octave for the musical note selected at the first handheld unit. In some implementations, for example, the second handheld unit can include two input buttons that can be depressed in a plurality of defined combinations to indicate selection of an octave for the selected musical note.

The second handheld unit 106 of the electronic musical instrument 102 can include one or more sensors, such as an accelerometer and/or the like for example, that can provide sensor data indicative of the motion of the second handheld unit 106 that can be used in generating a signal to initiate the output of the selected musical note. In some implementations, for example, the second handheld unit 106 can be moved by the user, for example, in a striking or hitting motion, to indicate that output of the selected musical note should be initiated.

Figure 2:
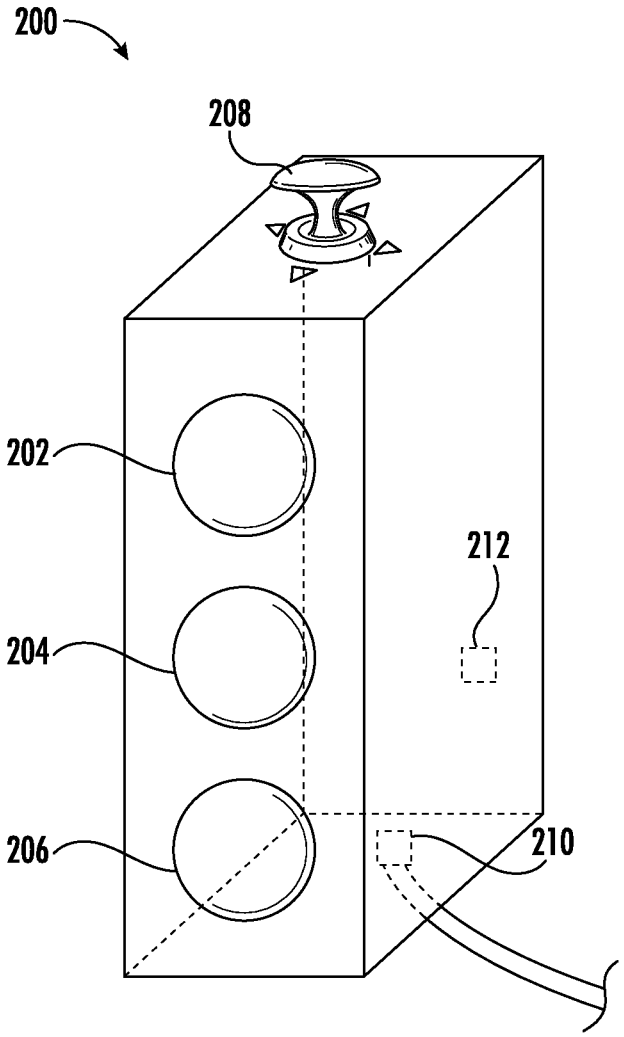
FIG. 2 depicts a diagram of a first handheld unit of an electronic musical device according to example embodiments of the present disclosure.

FIG. 2 depicts a diagram of a first handheld unit 200 of an electronic musical instrument according to example embodiments of the present disclosure. As illustrated in FIG. 2, a first handheld unit 200 of an electronic musical instrument (e.g., electronic musical instrument 102 of FIG. 1) can be configured to provide for selection of a musical note to be output by an audio output device (e.g., synthesizer, etc.) as described herein. In some implementations, the first handheld unit 200 can include three input controls, such as first button 202, second button 204, and third button 206, that can be concurrently operated (e.g., pressed) in defined combinations to indicate selections of a particular musical note of a musical scale (e.g., diatonic scale). For example, in some implementations, operation of the first button 202 can indicate a C of a diatonic scale. Operation of the first button 202 and second button 204 simultaneously can indicate a D of a diatonic scale. Operation of the second button 204 can indicate an E of a diatonic scale. Operation of the second button 204 and third button 206 simultaneously can indicate an F of a diatonic scale. Operation of the third button 206 can indicate a G of a diatonic scale. Operation of the first button 202 and third button 206 simultaneously can indicate an A of a diatonic scale. Operation of the first button 202, second button 204, and third button 206 simultaneously can indicate a B of a diatonic scale.

The first handheld unit 200 can include an additional input control, such as thumb stick 208, directional pad, and/or the like, that can be used to indicate the selection of additional aspects and/or effects to be applied to the selected musical notes. In some implementations, for example, the thumb stick 208 can be moved in a first direction (e.g., left, etc.) to indicate a sharp for the selected musical note. The thumb stick 208 can be moved in a second direction (e.g., right, etc.) to indicate a flat for the selected musical note.

In some implementations, the thumb stick 208 can be moved in a third (e.g., backward, etc.) direction or fourth (e.g., forward, etc.) direction to indicate a transposition for the selected musical notes. For example, the thumb stick 208 can be moved in a third (e.g., backward) direction to indicate a chromatic transposition, where the musical notes are shifted by a fixed number of steps (e.g. keys), for example, based on a change in the selected musical notes (e.g., a change of input control selection from a C to a D would cause a shift of one step in the next note being outputted, a change of input control selection from a C to an E would cause a shift of two steps in the next note being output, etc.). The thumb stick 208 can be moved in a fourth (e.g., forward) direction to indicate a diatonic transposition, where a next note to be outputted would move a fixed number of notes in the scale within the same key. In some implementations, the thumb stick 208 can be moved in a fifth direction (e.g., center down press, etc.) to indicate whether a normal mode or a legato mode should be applied for the selected musical note(s).

The first handheld unit 200 can include one or more sensors (e.g., accelerometer, etc.) that can provide sensor data for use in determining one or more aspects and/or effects to be applied to the selected musical note. For example, in some implementations, the first handheld unit 200 can be moved, for example, in a side to side rotating motion, to indicate an adjustment to the volume level of the musical note to be outputted. For example, the first handheld unit 200 can be rotated in a first direction to increase the volume of the musical note outputted and can be rotated in a second opposite direction to decrease the volume of the musical notes outputted.

Additionally, or alternatively, sensor data indicative of movement of the first handheld unit 200 in a forward/backward tilt motion after the selection of a second musical note (e.g., while the first (current) musical note is being held) can be used to indicate that a slide transition from the current musical note to the second musical note should be applied. For example, while the first selected musical note is being played (e.g., held), a user can indicate selection of a second musical note (e.g., by changing the pressed button combination on the first handheld unit 200) and move the first handheld unit 200 in a backward tilt motion to indicate a transition where the musical notes being outputted slide from the first musical note to the second musical note. Additionally, in some implementations, the user can move the first handheld unit 200 in a forward tilt motion to indicate a transition where the musical notes being outputted slide from the second musical note back to the first musical note. In some implementations, the repeated movement of the first handheld unit 200 in a forward/backward tilt motion can change the musical notes being output from a first note, to a second note, to a third note, to a fourth, note, etc. as one sustained series.

The first handheld unit 200 can include a first communication interface, such as communication cable port 210, to provide for communication between the first handheld unit 200 and a second handheld unit of the electronic musical instrument.

The first handheld unit 200 can include a second communication interface, for example a wireless communication interface (e.g., Bluetooth interface, etc.), to provide for connecting the electronic musical instrument to an audio output device. Such a communication interface can include the hardware (e.g., antennas, transistors, etc.) necessary to facilitate such wireless communication in accordance with the desired communication protocol.

The first handheld unit 200 can include a power control 212 to allow for powering the musical instrument on or off. The first handheld unit 200 can be connected to a power source (not shown). The power source can include a temporary/disposable battery, a chargeable battery (e.g., that takes wireless and/or wired charging), a cable/bus that allows the first handheld unit to be plugged into a power source (e.g., a wall power source), etc. In some implementations, the first handheld unit 200 can utilize the second handheld unit as a power source and/or the second handheld unit can serve as an intermediary via which the first handheld unit receives power.

Figure 3:
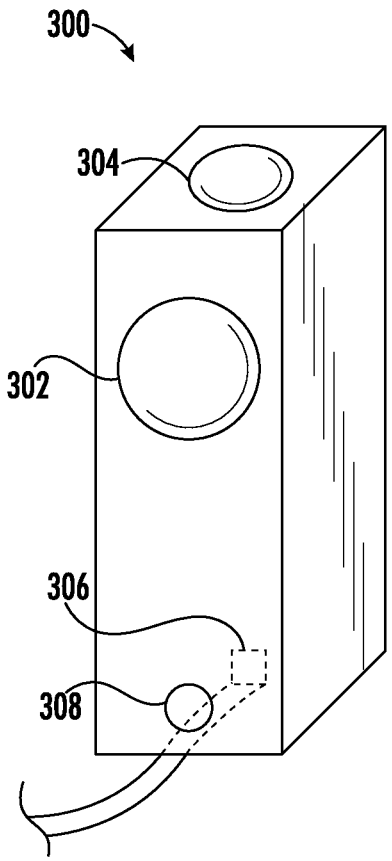
FIG. 3 depicts a diagram of a second handheld unit of an electronic musical device according to example embodiments of the present disclosure.

FIG. 3 depicts a block diagram of a second handheld unit 300 of an electronic musical instrument according to example embodiments of the present disclosure. As illustrated in FIG. 3, a second handheld unit 300 of an electronic musical instrument (e.g., electronic musical instrument 102 of FIG. 1) can be configured to provide for generating a signal that the output of a selected musical note (e.g., selected at a first handheld unit of the electronic musical instrument) should be initiated by an audio output device (e.g., synthesizer, etc.) as described herein. The second handheld unit 300 can be further configured to provide an indication of an octave for the selected musical note, as well as providing for the indication of one or more effects to be applied to the selected musical note.

The second handheld unit 300 can include one or more sensors (e.g., accelerometer, gyroscope, etc.) that can provide sensor data for use in determining that the output of a selected musical note should be initiated by an audio output device. For example, in some implementations, the second handheld unit 300 can be moved, for example, in a striking or hitting motion, to indicate that the output of the selected musical note should be initiated. In some implementations, the one or more sensors may be used in determining a force with which the motion of the second handheld unit is made and adjust an aspect of the musical note to be output, for example, increasing the volume of the musical note based on a harder hit motion or decreasing the volume of the musical note based on a softer hit motion. In some implementations, the second handheld unit 300 may allow for indicating other effects to be applied to the musical note based on a pattern of motion of the second handheld unit 300. As one example, the second handheld unit 300 may allow for modifying the output of the selected musical note by bending the pitch up or down slightly based on the second handheld unit 300 being moved in a shaking or repeating striking motion. In some implementations, the amount that the pitch is bent may correlate to how fast the second handheld unit 300 is moved and/or to the intensity of the movement of the second handheld unit 300.

The second handheld unit 300 can also include one or more input controls. For example, as shown in FIG. 3, the second handheld unit 300 can include two input controls, such as first button 302 and second button 304 that can be concurrently operated (e.g., pressed) in defined combinations to indicate selections of an octave for the selected musical note (e.g., selected at a first handheld unit of the electronic musical instrument). As an example, in some implementations, operation of the first button 302 only can indicate that the musical note should be outputted in a first (e.g., lowest) octave. Operation of the first button 302 concurrently with the second button 304 can indicate that the musical note should be outputted in a second (e.g., next higher) octave. Operation of the second button 304 only can indicate that the musical note should be outputted in a third (e.g., next higher) octave. An indication that the musical note should be outputted in a fourth (e.g., highest) octave can be generated when neither of the first button 302 or the second button 304 are operated.

The second handheld unit 300 can include a communication interface, such as communication cable port 306, to provide for communication between the second handheld unit 300 and a first handheld unit of the electronic musical instrument.

In some implementations, the second handheld unit 300 can also include an additional input control, such as button 308 for example, that can be used in adjusting one or more user-definable settings of the electronic musical instrument (e.g., play left-handed, play right-handed, type of voice, etc.). In some implementations, button 308 can be operated in conjunction with one or more input controls (e.g., buttons) of the first handheld unit and/or the second handheld unit to adjust one or more user-definable settings. As similarly described with respect to the first handheld unit of FIG. 2, the second handheld unit 300 can include a wireless communication interface and/or a power source. In some implementations, the second handheld unit 300 can utilize the first handheld unit as a power source and/or the first handheld unit can serve as an intermediary via which the second handheld unit receives power.

Figure 4:
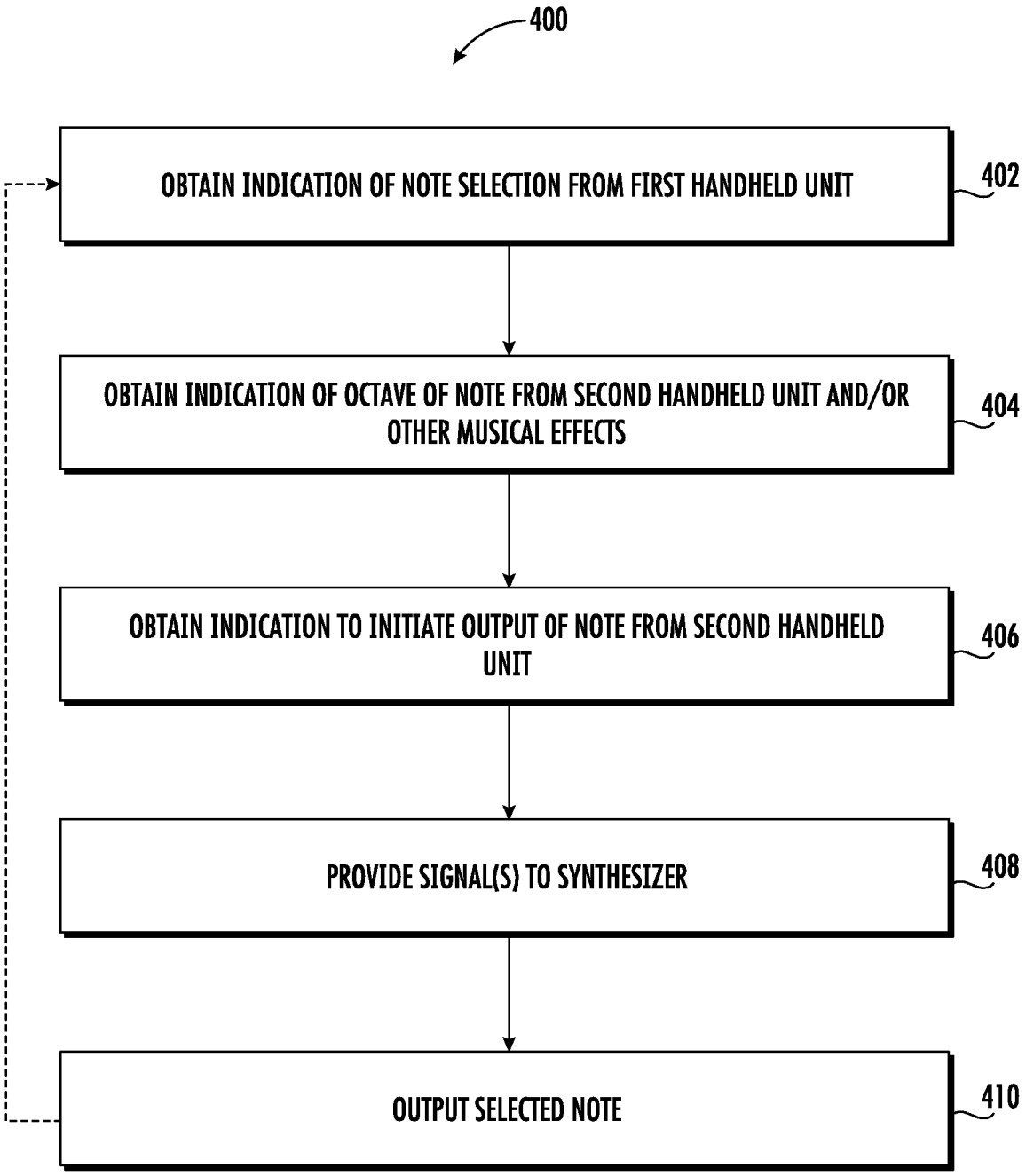
FIG. 4 depicts a flowchart diagram of example operations for generating music according to example embodiments of the present disclosure.

FIG. 4 depicts a flowchart diagram of example operations 400 for generating music according to example embodiments of the present disclosure. One or more portion(s) of the operations 400 can be implemented by one or more computing systems, for example, an electronic musical instrument, such as electronic musical instrument system 100 of FIG. 1, electronic musical instrument computing system 500 of FIG. 5, and/or the like. Each respective portion of the operations 400 can be performed by any (or any combination) of the computing device(s) of the respective computing system. Moreover, one or more portion(s) of the operations 400 can be implemented as an algorithm on the hardware components of the device(s) described herein (e.g., as in FIGS. 1 and 5), for example, to facilitate the generation of musical audio output. FIG. 4 depicts elements performed in a particular order for purposes of illustration and discussion. Those of ordinary skill in the art, using the disclosures provided herein, will understand that the elements of any of the methods discussed herein can be adapted, rearranged, expanded, omitted, combined, and/or modified in various ways without deviating from the scope of the present disclosure.

At (402), the operations 400 can include obtaining a signal indicative of a selected musical note from a first handheld unit of an electronic musical instrument (e.g., first handheld unit 104 of FIG. 1, first handheld unit 200 of FIG. 2, etc.). For example, one or more of the input controls (e.g., buttons, etc.) of the first handheld unit can be manipulated, interacted with, etc. (e.g., depressed) concurrently to generate a signal indicative of a selected musical note (e.g., notes of a diatonic scale, etc.). In some implementations, the first handheld unit can include three input controls (e.g., buttons, etc.) configured to generate signals indicative of musical note selection, whereby each combination of concurrently pressed buttons is indicative of a particular note of a scale (e.g., a C, D, E, F, G, A, or B of a C major diatonic scale, etc.).

At (404), a signal indicative of an octave for the selected musical note can be obtained from a second handheld unit of an electronic musical instrument (e.g., second handheld unit 106 of FIG. 1, second handheld unit 300 of FIG. 3, etc.). For example, one or more of the input controls (e.g., buttons, etc.) of the second handheld unit can be manipulated, interacted with, etc. (e.g., depressed) concurrently to generate a signal indicative of a desired octave for the selected musical note. In some implementations, the second handheld unit can include two input controls (e.g., buttons, etc.) configured to generate signals indicative of an octave selection, whereby each combination of concurrently pressed buttons is indicative of a particular octave.

The operations 400 can also include (at 404), obtaining a signal indicative of one or more other musical effect(s) to be implemented. For example, in some implementations, one or more sensors of the second handheld unit may be used to determine a force with which the motion of the second handheld unit is made and adjust an aspect of the musical note being output. This can include, for example, increasing the volume of the musical note based on a harder hit motion or decreasing the volume of the musical note based on a softer hit motion. In some implementations, the second handheld unit may determine other aspects to be applied for the output of the musical note based on a pattern of motion of the second handheld unit. For example, the second handheld unit may determine that a modification should be applied to the musical note being output, such as bending the pitch up or down slightly, based on the user making a repeating striking motion with the second handheld unit. In some implementations, the amount that the pitch is bent may correlate to how fast the second handheld unit is moved and/or to the intensity of the movement of the second handheld unit. As described herein, in some implementations, an additional input control (e.g., thumb stick, directional pad, etc.) of the first handheld unit can be manipulated (e.g., in accordance with a first direction or second direction) to indicate a sharp or flat for the selected musical note (e.g., based on the input buttons that are being pressed concurrently with the thumb stick movement). Additionally, or alternatively, an additional input control can be interacted with in one or more pre-defined manners (e.g., in accordance with certain direction(s)) to indicate a transposition for the selected musical notes. Additionally, or alternatively, an additional input control can be interacted with in one or more pre-defined manners (e.g., in accordance with certain direction(s)) to indicate whether a normal mode or a legato mode should be applied for the selected musical notes.

As described herein, in some implementations, the first handheld unit can also include one or more sensors that can provide sensor data for use in determining one or more aspects of the musical note selected to be generated as audio output. For instance, the first handheld unit can be moved by the user, in a side to side rotating motion, to indicate an adjustment to the volume level of the musical note being outputted. In another example, a user can rotate the first handheld unit in a first direction to increase the volume of the musical notes outputted and can rotate the first handheld unit in a second opposite direction to decrease the volume of the musical notes outputted.

Additionally, or alternatively, the musical note being outputted can be held (e.g., continue to be played) until all the input controls are released. In such implementations, this can allow for a second musical note to be selected such that the second musical note is played immediately upon the user making the appropriate motion with the second handheld unit (e.g., a hitting motion), for example, based on a normal mode being selected via a control of the first handheld unit. Further, in such implementations, the sensor data indicative of movement of the first handheld unit (e.g., a forward/backward tilt motion of the first handheld unit) after the selection of a second musical note (e.g., while the first, current musical note is being output) can be used to indicate that a slide transition from the first musical note to the second musical note should be applied. For example, while the first selected musical note is being played (e.g., held), a user can indicate selection of a second musical note (e.g., by changing the input buttons depressed on the first handheld unit) and move at least one of the handheld units (e.g., the first handheld unit) in a backward tilt motion to indicate a transition, as described herein. Additionally, or alternatively, the user can move at least one handheld unit (e.g., the first handheld unit) in a forward tilt motion to indicate a transition where the musical notes being outputted slide from the second musical note back to the first musical note. Additionally, or alternatively, the user can move at least one handheld unit (e.g., the first handheld unit) in a repeated backward/forward tilt motion to indicate a transition where the musical notes slide from a first musical note, to a second musical note, to a third musical note, to a fourth musical note, etc. as one sustained series.

At (406), a signal to initiate the output of the selected musical note can be obtained from the second handheld unit. For example, the second handheld unit can include one or more sensors (e.g., an accelerometer, etc.) that can generate data indicative of the motion of the second handheld unit. In some implementations, a user making a hitting or striking motion with the second handheld unit can cause a signal to be generated to initiate the output of the selected musical note.

At (408), the signal data can be provided to an output device, for example a synthesizer, for use in generating audio output. At 410, the output device can generate the audio output based at least in part on the signal data.

Figure 5:
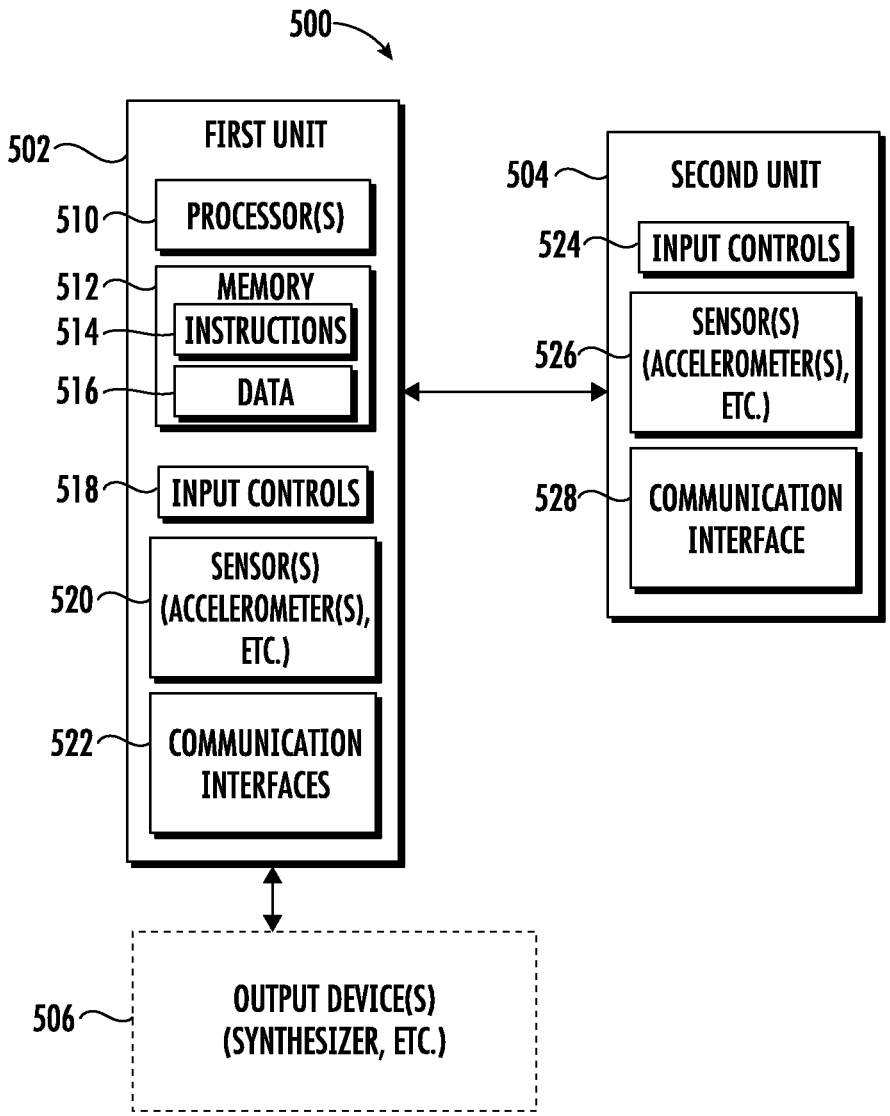
FIG. 5 depicts a block diagram of an example electronic musical device computing system according to example embodiments of the present disclosure.

FIG. 5 depicts a block diagram of an example electronic musical instrument computing system 500 according to example embodiments of the present disclosure. The example computing system 500 illustrated in FIG. 5 is provided as an example only. The components, systems, connections, and/or other aspects illustrated in FIG. 5 are optional and are provided as examples of what is possible, but not required, to implement the present disclosure. As illustrated in FIG. 5, the electronic musical instrument computing system 500 can include a first handheld unit 502 and a second handheld unit 504 that are communicatively connected and which can be configured to provide for the generation of musical notes, for example, by an output device 506 (e.g., synthesizer, etc.). The first handheld unit 502 and the second handheld unit 504 can respectively correspond to the first and second handheld units described herein with respect to the other figures.

The first handheld unit 502 can include processor(s) 510 and a least one memory 512. The one or more processors 510 can be any suitable processing device (e.g., a processor core, a microprocessor, an ASIC, a FPGA, a controller, a microcontroller, etc.) and can be one processor or a plurality of processors that are operatively connected. The memory 512 can include one or more non-transitory computer-readable storage media, such as RAM, ROM, EEPROM, EPROM, one or more memory devices, flash memory devices, etc., and combinations thereof.

The memory 512 can store information that can be accessed by the one or more processors 510. For instance, the memory 512 (e.g., one or more non-transitory computer-readable storage mediums, memory devices) can include computer-readable instructions 514 that can be executed by the one or more processors 510. The instructions 514 can be software written in any suitable programming language or can be implemented in hardware. Additionally, or alternatively, the instructions 514 can be executed in logically and/or virtually separate threads on processor(s) 510.

For example, the memory 512 can store instructions 514 that when executed by the one or more processors 510 cause the one or more processors 510 to perform operations such as any of the operations and functions of the electronic musical instrument or for which the electronic musical instrument (e.g., first handheld unit 502 and second handheld unit 504) are configured, as described herein including, for example, operations of FIG. 4.

The first handheld unit 502 can include a plurality of input controls 518 that can be configured to provide for the selection of musical notes to be outputted (e.g., by output device 506, etc.), such as, for example, the musical note selection buttons 202, 204, and 206 of FIG. 2. The input controls 518 can further include input controls that can be configured to provide for the selection of aspects and/or effects to be applied to a selected musical note, such as, for example, thumb stick 208 of FIG. 2.

The first handheld unit 502 can also include one or more sensors 520 (e.g., accelerometers, gyroscope, other motion sensor(s), etc.) that can generate data indicative of the motion of the first handheld unit 502 for use in determining one or more aspects and/or effects to be applied to a selected musical note.

The first handheld unit 502 can also include one or more communication interfaces 522 that can be configured to provide for communication with one or more other computing devices associated with the electronic musical instrument computing system 500. For example, the first handheld unit 502 can include a communication interface to allow for communication with the second handheld unit 504 (e.g., communication interface 210 of FIG. 2), a communication interface to allow for communication with output device(s) 506 (e.g., wireless (Bluetooth) communication interface(s)), and/or the like. The communication interface can include for example, one or more of a communications controller, receiver, transceiver, transmitter, port, conductors, software and/or hardware for communicating data.

The second handheld unit 504 can include a plurality of input controls 524 that can be configured to provide for the selection of an octave for a selected musical note (e.g., selected at first handheld device 502), such as, for example, the octave selection buttons 302 and 304 of FIG. 3. The input controls 524 can optionally include input controls that can be configured to provide for the selection of user-definable settings to be applied to the electronic musical instrument, such as, for example, settings button 308 of FIG. 3 (e.g., in conjunction with operation of one or more other input controls of the first handheld unit and/or the second handheld unit).

The second handheld unit 504 can also include one or more sensors 526 (e.g., accelerometers, etc.) that can generate data indicative of the motion of the second handheld unit 504 for use in determining when output of a selected musical note should be initiated. The one or more sensors 526 to generate data that can also be used in determining one or more aspects and/or effects to be applied to a selected musical note.

The second handheld unit 504 can also include one or more communication interfaces 528 that can be configured to provide for communication with one or more other computing devices associated with the electronic musical instrument computing system 500. For example, the second handheld unit 504 can include a communication interface 528 to allow for communication with the output device(s) 506. The communication interface 528 can include for example, one or more of a communications controller, receiver, transceiver, transmitter, port, conductors, software and/or hardware for communicating data. The communication interface 528 can be configured to allow the second handheld unit 504 to conduct wireless and/or wired communication. The second handheld device can include processor(s) and memory (e.g., including instructions, data, etc.) in a similar manner as that described for first handheld unit 502.

The first and/or second handheld units 502, 504 configured to communicate with one or more output device(s) 506. For example, in some implementations, the second handheld unit 504 can be configured to communicate with the first handheld unit 502, and the first handheld unit 502 can in turn be configured to communicate with one or more output device(s) 506. The output device(s) 506 can include the software and/or hardware to generated audible outputs in accordance with the musical notes and/or effects selected via the first and second handheld units. The output device(s) 506 can include a synthesizer and/or other such devices that can be utilized for outputting audible signals. The output device (s) 506 can include a speaker by which the audible signals can be outputted. The output device(s) 506 can include processor(s) and memory as similarly described herein.

Computing tasks discussed herein as being performed by the first handheld unit can be performed by the second handheld unit, or vice versa. Such configurations can be implemented without deviating from the scope of the present disclosure. The use of computer-based systems allows for a great variety of possible configurations, combinations, and divisions of tasks and functionality between and among components. Computer-implemented operations can be performed on a single component or across multiple components. Computer-implements tasks and/or operations can be performed sequentially or in parallel. Data and instructions can be stored in a single memory device or across multiple memory devices.

While the present subject matter has been described in detail with respect to various specific example embodiments thereof, each example is provided by way of explanation, not limitation of the disclosure. Those skilled in the art, upon attaining an understanding of the foregoing, can readily produce alterations to, variations of, and equivalents to such embodiments. Accordingly, the subject disclosure does not preclude inclusion of such modifications, variations and/or additions to the present subject matter as would be readily apparent to one of ordinary skill in the art. For instance, features illustrated or described as part of one embodiment can be used with another embodiment to yield a still further embodiment. Thus, it is intended that the present disclosure cover such alterations, variations, and equivalents.

What is claimed is:

1. An electronic musical instrument comprising:

a first handheld unit; and a second handheld unit, the second handheld unit being communicatively coupled to the first handheld unit;

wherein the first handheld unit comprises a plurality of input controls configured to indicate a selected note of a diatonic scale; and wherein the second handheld unit is configured to initiate output of the selected note based on a determination of a motion of the second handheld unit, wherein the first handheld unit is configured to indicate a transition from the selected note to a second selected note based on data indicating a motion of the first handheld unit.

2. The electronic musical instrument of claim 1, wherein the plurality of input controls of the first handheld unit comprises at least three input controls, the three input controls configured to indicate the selected note based on one of a plurality of combinations of the three input controls.

3. The electronic musical instrument of claim 2, wherein the first handheld unit comprises a fourth input control, the fourth input control configured to change at least one of the selected note to a sharp based on a selected first position of the fourth input control or the selected note to a flat based on a selected second position of the fourth input control.

4. The electronic musical instrument of claim 3, wherein the fourth input control is further configured to provide at least one of a chromatic transposition based on a selected third position of the fourth input control or a diatonic transposition based on a selected fourth position of the fourth input control.

5. The electronic musical instrument of claim 1, wherein the second handheld unit comprises at least two input controls, the two input controls configured to indicate a selection of an octave for the selected note.

6. The electronic musical instrument of claim 1, wherein the first handheld unit further comprises a sensor, and wherein the first handheld unit is configured to indicate that an output volume of the selected note is to be increased based on sensor data indicating a first motion of the first handheld unit or decreased based on sensor data indicating a second motion of the first handheld unit.

7. The electronic musical instrument of claim 1, wherein the second handheld unit further comprises a sensor, and wherein the second handheld unit is configured to initiate the output of the selected note based on sensor data indicating the motion of the second handheld unit.

8. The electronic musical instrument of claim 7, wherein the second handheld unit is further configured to indicate that the selected note should be output with modified pitch based on sensor data indicating a series of motions of the second handheld unit.

9. The electronic musical instrument of claim 1, wherein the first handheld unit further comprises a communication interface, the communication interface configured to provide for communicating one or more signals between the electronic musical instrument and a music synthesizer, wherein the music synthesizer produces the selected note based on the one or more signals from the electronic musical instrument.

10. A computer-implemented method for generating music, the method comprising:

obtaining, by a computing system, an indication of a selected note selected at a first handheld unit, wherein the first handheld unit is configured to indicate a transition from the selected note to a second selected note based on data indicating a motion of the first handheld unit;

obtaining, by the computing system, an indication of an octave or one or more other musical effects for the selected note from a second handheld unit;

obtaining, by the computing system via the second handheld unit, an indication to initiate output of the selected note, the indication to initiate output of the selected note based on a determination of motion of the second handheld unit; and providing, by the computing system to an output device, one or more signals to generate audio output comprising the selected note.

11. The computer-implemented method of claim 10, wherein the plurality of input controls of the first handheld unit comprises at least three input controls, the three input controls configured to indicate the selected note based on one of a plurality of combinations of the three input controls.

12. The computer-implemented method of claim 11, wherein the first handheld unit comprises a fourth input control, the fourth input control configured to change the selected note to a sharp based on a selected first position of the fourth input control or to change the selected note to a flat based on a selected second position of the fourth input control.

13. The computer-implemented method of claim 10, wherein the second handheld unit comprises at least two input controls, the two input controls configured to indicate a selection of an octave for the selected note.

14. The computer-implemented method of claim 10, wherein the first handheld unit further comprises an accelerometer, and wherein the first handheld unit is configured to indicate that the output volume of the selected note should be increased based on accelerometer data indicating a first motion of the first handheld unit or decreased based on accelerometer data indicating a second motion of the first handheld unit.

15. The computer-implemented method of claim 10, wherein the second handheld unit further comprises an accelerometer, and wherein the second handheld unit is configured to initiate the output of the selected note based on accelerometer data indicating the motion of the second handheld unit.

16. The computer-implemented method of claim 10, wherein the first handheld unit further comprises a communication interface, the communication interface configured to provide for communicating one or more signals to an output device, wherein the output device produces the selected note based on the one or more signals.

17. A system comprising:

a first handheld unit comprising a plurality of input controls;

a second handheld unit comprising a plurality of input controls, the second handheld unit being communicatively coupled to the first handheld unit; and one or more output devices, the one or more output devices being in communication with the first handheld unit;

the first handheld unit further comprising:

one or more processors; and one or more memories including instructions that, when executed by the one or more processors, cause the one or more processors to perform operations, the operations comprising:

determining a selected note based on activation of one or more of the plurality of input controls, wherein the first handheld unit is configured to indicate a transition from the selected note to a second selected note based on data indicating a motion of the first handheld unit;

obtaining an indication of an octave or one or more other musical effects for the selected note from the second handheld unit;

obtaining an indication to initiate output of the selected note from the second handheld unit, the indication to initiate output of the selected note based at least in part on a determination of a motion of the second handheld unit; and providing one or more signals to the one or more output devices to provide for generation of sound output based on the selected note.

18. The system of claim 17, wherein the plurality of input controls of the first handheld unit comprises at least three input controls, the three input controls configured to indicate the selected note based on one of a plurality of combinations of the three input controls.

19. The system of claim 17, wherein the second handheld unit comprises at least two input controls, the two input controls configured to indicate a selection of an octave for the selected note.

20. An electronic musical instrument comprising:

a first handheld unit; and a second handheld unit, the second handheld unit being communicatively coupled to the first handheld unit;

wherein the first handheld unit comprises a plurality of input controls configured to indicate a selected note of a diatonic scale; and wherein the second handheld unit is configured to initiate output of the selected note based on a determination of a motion of the second handheld unit, wherein the first handheld unit further comprises a sensor, and wherein the first handheld unit is configured to indicate that an output volume of the selected note is to be increased based on sensor data indicating a first motion of the first handheld unit or decreased based on sensor data indicating a second motion of the first handheld unit.

* * * * *